US011017633B2

(12) United States Patent
Amaitis et al.

(10) Patent No.: US 11,017,633 B2
(45) **Date of Patent: *May 25, 2021**

(54) SYSTEM AND METHOD FOR BETTING ON-THE-BOARD OR OFF-THE-BOARD IN AN EVENT

(71) Applicant: CANTOR INDEX LLC, New York, NY (US)

(72) Inventors: Lee M. Amaitis, Las Vegas, NV (US); Joseph M. Asher, Las Vegas, NV (US); Adam Burgis, London (GB); Dominic Crosthwaite, London (GB)

(73) Assignee: CANTOR INDEX LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/723,459

(22) Filed: Dec. 20, 2019

(65) Prior Publication Data

US 2020/0126360 A1 Apr. 23, 2020

Related U.S. Application Data

(60) Continuation of application No. 15/370,828, filed on Dec. 6, 2016, now Pat. No. 1,529,188, which is a (Continued)

(51) Int. Cl.
*G07F 17/32* (2006.01)

(52) U.S. Cl.
CPC ..... *G07F 17/3258* (2013.01); *G07F 17/32* (2013.01); *G07F 17/3225* (2013.01); *G07F 17/3288* (2013.01)

(58) Field of Classification Search
CPC ..... A63K 1/00; A63K 3/00; A63F 3/00082; A63F 13/65; G07F 17/32
See application file for complete search history.

(56) References Cited

U.S. PATENT DOCUMENTS 4,874,177 A 10/1989 Girardin
4,962,950 A 10/1990 Champion
(Continued)

FOREIGN PATENT DOCUMENTS

GB 1574447 9/1980
GB 2180675 4/1987
(Continued)

OTHER PUBLICATIONS

The History of Horse Racing, http://www.mrmike.com/explore/hrhist.htm, Copyright Date 1996-1998. Relevant Portions Highlighted.

(Continued)

*Primary Examiner* — Omkar A Deodhar

(57) ABSTRACT

A system for managing bets comprises a memory and a processor. The memory stores one or more first type of bets and one or more second types of bets. Each first type of bet is associated with a bet amount and comprises a bet that a participant selected from a set of participants in an event will finish in a predetermined subset of finishing positions associated with the event. Each second type of bet is associated with a bet amount and comprises a bet that the selected participant will not finish in the predetermined subset of finishing positions associated with the event. The processor adds the bet amounts associated with the first type of bets with the bet amounts associated with the second type of bets to form a betting pool. The processor determines an amount of a payout based at least in part on the betting pool.

20 Claims, 4 Drawing Sheets

Related U.S. Application Data continuation of application No. 14/085,935, filed on Nov. 21, 2013, now Pat. No. 10,223,869, which is a continuation of application No. 13/615,458, filed on Sep. 13, 2012, now Pat. No. 8,591,321, which is a continuation of application No. 12/248,145, filed on Oct. 9, 2008, now Pat. No. 8,360,860, which is a division of application No. 10/453,761, filed on Jun. 3, 2003, now Pat. No. 7,452,274.

(60) Provisional application No. 60/459,561, filed on Mar. 31, 2003.

(56) References Cited

U.S. PATENT DOCUMENTS

| | | | |
|---|---|---|---|
| 5,575,474 | A | 11/1996 | Rossides |
| 5,586,937 | A | 12/1996 | Menashe |
| 5,713,793 | A | 2/1998 | Holte |
| 5,743,525 | A | 4/1998 | Haddad |
| 5,842,921 | A | 12/1998 | Mindes et al. |
| 5,888,136 | A | 3/1999 | Herbert |
| 5,957,775 | A | 9/1999 | Cherry |
| 6,058,379 | A | 5/2000 | Odom et al. |
| 6,113,492 | A | 9/2000 | Walker et al. |
| 6,126,543 | A | 10/2000 | Friedman |
| 6,152,822 | A | 11/2000 | Herbert |
| 6,206,782 | B1 | 3/2001 | Walker et al. |
| 6,296,569 | B1 | 10/2001 | Congello, Jr. |
| 6,309,307 | B1 | 10/2001 | Krause et al. |
| 6,325,721 | B1 | 12/2001 | Miyamoto et al. |
| 6,331,148 | B1 | 12/2001 | Krause et al. |
| 6,358,150 | B1 | 3/2002 | Mir et al. |
| 6,450,887 | B1 | 9/2002 | Mir et al. |
| 6,527,270 | B2 | 3/2003 | Maksymec et al. |
| 7,452,274 | B2 | 11/2008 | Amaitis et al. |
| 8,360,860 | B2 | 1/2013 | Amaitis et al. |
| 8,591,321 | B2 | 11/2013 | Amaitis et al. |
| 1,052,918 | A1 | 1/2020 | Amaitis et al. |
| 2001/0031659 | A1 | 10/2001 | Perrie et al. |
| 2001/0039209 | A1 | 11/2001 | DeWeese et al. |
| 2001/0051540 | A1 | 12/2001 | Hindman et al. |
| 2002/0094869 | A1 | 7/2002 | Harkham |
| 2002/0115488 | A1 | 8/2002 | Berry et al. |
| 2003/0119582 | A1 | 6/2003 | Ocampo |
| 2008/0139263 | A1 | 6/2008 | He et al. |
| 2014/0087859 | A1 | 3/2014 | Amaitis et al. |
| 2017/0084125 | A1 | 3/2017 | Amaitis et al. |

FOREIGN PATENT DOCUMENTS

| | | |
|---|---|---|
| GB | 2299425 | 10/1996 |
| WO | WO 2000/079442 | 12/2000 |
| WO | WO 2001/077861 | 10/2001 |
| WO | WO 2001/077964 | 10/2001 |

OTHER PUBLICATIONS

PCT Search Report for PCT/US04/10069; dated Jun. 17, 2005.
"MTRA All Star Jockey Championship Special Wagers", 3 pages; not dated.
"Wagering Information; Straight of Basic Wagers," Lone Star Park at Grand prairie; Players Guide, http://www.lonestarpark.com/bet_info.asp, 3 pages; not dated.
"Wagering Information: Straight of Basic Wagers," NTRA.com; http://www.ntra.com/news.asp?type=playthehorse&id=4799, 3 pages; not dated.
"Glossary of terms," NTRA.com; http://www.ntra.com/news.asp?type=playthehorses&id=4797,; 3 pages; not dated.
"The Basics of Horseplay," NTRA.com; http://www.ntra.com/news.asp?type=playthehorses&id=4795; 2 pages; not dated.
"Bet with the people who know racing," Racing Daily Forum, 15 pages; Jul. 24, 2001.
"Quote of the Day; bet of the Day," London Times; 1 page; Jul. 30, 2003.
Scarne, "Scarne's New Complete Guide to Gambling," Simon & Schuester, pp. 46-48 plus title and copyright pp.; 2 pages; 1961.
PCT Search report for PCT/US04/09797; 9 pages; dated May 13, 2005.
The Patent Office Search Report from International Application No. GB 0320232.2; 6 pages; dated Dec. 17, 2003.
U.S. Office Action for U.S. Appl. No. 10/453,761; 5 pages; dated Apr. 4, 2005.
U.S. Office Action for U.S. Appl. No. 10/453,761; 9 pages; dated Jul. 15, 2005.
U.S. Office Action for U.S. Appl. No. 10/453,761; 10 pages; dated Feb. 7, 2006.
U.S. Office Action for U.S. Appl. No. 10/453,761; 12 pages; dated Oct. 17, 2006.
U.S. Office Action for U.S. Appl. No. 10/453,761; 12 pages; dated Apr. 17, 2007.
U.S. Office Action for U.S. Appl. No. 10/453,761; 9 pages; dated Oct. 1, 2007.
U.S. Office Action for U.S. Appl. No. 10/453,761; 7 pages; dated May 9, 2008.
U.S. Notice of Allowance for U.S. Appl. No. 10/453,761; 6 pages; dated Jul. 30, 2008.
U.S. Notice of Allowance for U.S. Appl. No. 12/248,145; 7 pages; dated Aug. 28, 2012.
U.S. Office Action for U.S. Appl. No. 13/615, 458; 8 pages; dated Mar. 14, 2013.

100 BETTING POOL = TOTAL ON-THE-BOARD BET AMOUNTS + TOTAL OFF-THE-BOARD BET AMOUNTS

102 TAKE-OUT = COMMISSION RATE * BETTING POOL

104 ON-THE-BOARD PAYOUT PER DOLLAR (AFTER TAKE-OUT) = (BETTING POOL - TAKE-OUT) / (TOTAL ON-THE-BOARD BET AMOUNTS)

106 OFF-THE-BOARD PAYOUT PER DOLLAR (AFTER TAKE-OUT) = (BETTING POOL - TAKE-OUT) / (TOTAL OFF-THE-BOARD BET AMOUNTS)

*FIG. 2A*

108 ON-THE-BOARD PAYOUT PER DOLLAR (WITHOUT TAKE-OUT) = (BETTING POOL) / (TOTAL ON-THE-BOARD BET AMOUNTS)

110 OFF-THE-BOARD PAYOUT PER DOLLAR (WITHOUT TAKE-OUT) = (BETTING POOL) / (TOTAL OFF-THE-BOARD BET AMOUNTS)

*FIG. 2B*

150

*FIG. 3*

| | 22 ON-THE-BOARD BETS | 24 OFF-THE-BOARD BETS | 52: 154 TOTAL ON-THE-BOARD BET AMOUNTS | 52: 156 TOTAL OFF-THE-BOARD BET AMOUNTS | 54 BETTING POOL | 158 TAKE-OUT (AT 15% RATE) | 56: 160 ON-THE-BOARD PAYOUT PER DOLLAR | 56: 162 OFF-THE-BOARD PAYOUT PER DOLLAR |
|---|---|---|---|---|---|---|---|---|
| 152a | HORSE #3 TO FINISH IN FIRST PLACE, SECOND PLACE, OR THIRD PLACE IN THE EVENT | HORSE #3 TO NOT FINISH IN FIRST PLACE, SECOND PLACE, OR THIRD PLACE IN THE EVENT | $500 | $1,000 | $1,500 | $225 | ($1,500 - $225) / $500 = $2.55 | ($1,500 - $225) / $1,000 = $1.27 |
| 152b | EITHER HORSE #3 OR #4 TO FINISH IN FIRST PLACE, SECOND PLACE, OR THIRD PLACE IN THE EVENT | NEITHER HORSE #3 NOR #4 TO FINISH IN FIRST PLACE, SECOND PLACE, OR THIRD PLACE IN THE EVENT | $1,000 | $500 | $1,500 | $225 | ($1,500 - $225) / $1,000 = $1.27 | ($1,500 - $225) / $500 = $2.55 |
| 152c | HORSE #5 TO FINISH IN FIRST PLACE IN THE EVENT | HORSE #5 TO NOT FINISH IN FIRST PLACE IN THE EVENT | $250 | $2,000 | $2,250 | $337.50 | ($2,250 - $337.50) / $250 = $7.65 | ($2,250 - $337.50) / $2,000 = $.95 ADJUSTED to $1.05 |
| 152d | HORSE #7 TO FINISH IN LAST PLACE IN THE EVENT | HORSE #7 TO NOT FINISH IN LAST PLACE IN THE EVENT | $1,200 | $3,000 | $4,200 | $630 | ($4,200 - $630) / $1,200 = $2.97 | ($4,200 - $630) / $3,000 = $1.19 |
| 152e | BOTH HORSE #3 AND HORSE #4 TO FINISH IN FIRST PLACE, SECOND PLACE, OR THIRD PLACE IN THE EVENT | AT LEAST ONE OF HORSE #3 OR #4 TO NOT FINISH IN FIRST PLACE, SECOND PLACE, OR THIRD PLACE IN THE EVENT | $500 | $1,500 | $2,000 | $300 | ($2,000 - $300) / $500 = $3.40 | ($2,000 - $300) / $1,500 = $1.13 |

SYSTEM AND METHOD FOR BETTING ON-THE-BOARD OR OFF-THE-BOARD IN AN EVENT

CROSS REFERENCE TO RELATED APPLICATIONS

This application is a continuation of U.S. patent application Ser. No. 15/370,828 issued on Dec. 6, 2016 which is a continuation of U.S. patent application Ser. No. 14/085,935 filed Nov. 21, 2013 (now U.S. Pat. No. 10,223,869 issued on Mar. 5, 2019) which is a continuation of U.S. patent application Ser. No. 13/615,458, filed Sep. 13, 2012 (now U.S. Pat. No. 8,591,321 issued on Nov. 26, 2013), which is a continuation of U.S. patent application Ser. No. 12/248,145 filed Oct. 9, 2008 (now U.S. Pat. No. 8,360,860 issued on Jan. 29, 2013), which is a divisional of U.S. patent application Ser. No. 10/453,761 filed Jun. 3, 2003 (now U.S. Pat. No. 7,452,274 issued on Nov. 18, 2008), which is related to and claims the benefit of U.S. Provisional Application No. 60/459,561, filed Mar. 31, 2003, each of which is hereby incorporated by reference herein in its entirety.

TECHNICAL FIELD OF THE INVENTION

This invention relates in general to betting on events and, more particularly, to a system and method for betting on-the-board or off-the-board in an event.

BACKGROUND OF THE INVENTION

Wagering on sporting events, such as horse races, for example, is a large and growing industry in many parts of the world. Various types of betting products or systems are available for various types of sporting events For example, typical horse racing bets allow bettors to bet on a single horse or on several horses in a particular race or series of races. For instance, a bettor can bet on a particular horse to finish first (win), finish in the top two (place), or finish in the top three (show). A bettor may also make various combination bets with multiple horses, such as an exacta bet (covering the top two horses in order) or a trifecta bet (covering the top three horses in order). In addition, a bettor may bet on a series of races, such as the daily double (winners of two consecutive races), the pick-three (winners of three consecutive races), and the pick-six (winners of six consecutive races), for example.

In a pari-mutuel betting system, all bets regarding a particular event are aggregated, a commission (or "take-out") is taken by the track, and the remainder is distributed among the winning bettors. For example, pari-mutuel betting systems are commonly used in North America (and other various places throughout the world) for betting on horse races.

SUMMARY OF THE INVENTION

In one embodiment, a method for managing bets comprises receiving one or more first type of bets, each first type of bet associated with a bet amount and comprising a bet that a participant selected from a set of participants in an event will finish in a predetermined subset of finishing positions associated with the event. The method continues by receiving one or more second type of bets, each second type of bet associated with a bet amount and comprising a bet that the selected participant will not finish in the predetermined subset of finishing positions associated with the event. The method continues by adding the bet amounts associated with the first type of bets with the bet amounts associated with the second type of bets to form a betting pool. The method concludes by determining an amount of a payout based at least in part on the betting pool.

In another embodiment, a system for managing bets comprises a memory and a processor. The memory stores one or more first type of bets and one or more second types of bets. Each first type of bet is associated with a bet amount and comprises a bet that a participant selected from a set of participants in an event will finish in a predetermined subset of finishing positions associated with the event. Each second type of bet is associated with a bet amount and comprises a bet that the selected participant will not finish in the predetermined subset of finishing positions associated with the event. The processor adds the bet amounts associated with the first type of bets with the bet amounts associated with the second type of bets to form a betting pool. The processor determines an amount of a payout based at least in part on the betting pool.

Various embodiments of the present invention may benefit from numerous advantages. It should be noted that one or more embodiments may benefit from some, none, or all of the advantages discussed below.

The on-the-board bets and off-the-board ("on or off") bets described herein may appeal to bettors that do not like to bet on the participants who are favored in a particular event. These bets also appeal to bettors seeking an alternative to a traditional "across-the-board" wager (which is in reality a series of wagers to win, place, and show on one horse in one race), either because of the lower nominal cost of the wager (e.g., $2 for an "on or off" bet versus $6 for an "across-the-board" bet), or because of the possibility of a better return. Other advantages include the fact that the "on or off" bets are structured into separate betting pools for determining payouts.

Other advantages will be readily apparent to one having ordinary skill in the art from the following figures, descriptions, and claims.

BRIEF DESCRIPTION OF THE DRAWINGS

For a more complete understanding of the present invention and for further features and advantages, reference is now made to the following description, taken in conjunction with the accompanying drawings, in which:

FIG. 2A illustrates various equations for calculating the potential payouts for on-the-board bets and off-the-board bets, accounting for take-out;

FIG. 2B illustrates various equations for calculating the potential payouts for on-the-board bets and off-the-board bets, without accounting for take-out;

FIG. 3 illustrates a table depicting example bet data for various on-the-board bets and corresponding off-the-board bets.

DETAILED DESCRIPTION OF EXAMPLE EMBODIMENTS OF THE INVENTION

Figure 1:
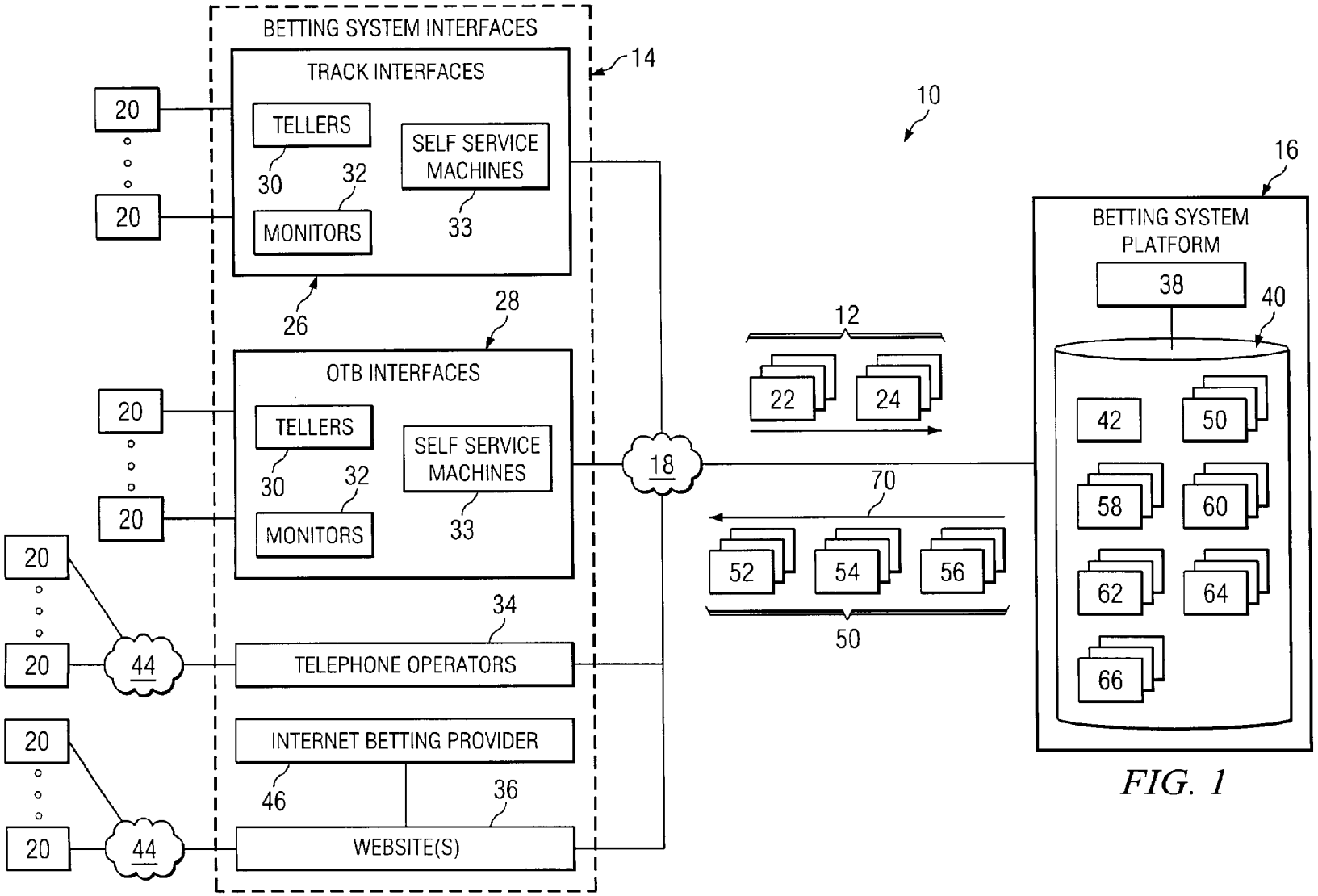
FIG. 1 illustrates a system for receiving and managing on-the-board bets and off-the-board bets in accordance with an embodiment of the present invention.

FIG. 1 illustrates an example system 10 for receiving and managing bets 12 in accordance with an embodiment of the present invention. System 10 includes one or more betting system interfaces 14 and a betting system platform 16 coupled by one or more communication networks 18. In general, one or more clients 20 may receive betting information (such as event times, betting rules, betting options and odds, for example) and/or place bets 12 via betting system interfaces 14. Betting system interfaces 14 communicate such bets 12 received from clients 20 to betting system platform 16. Betting system platform 16 stores the received bets 12, determines appropriate odds and payouts, and communicates such odds and payouts to one or more of the betting system interfaces 14.

System 10 permits clients 20 to place at least both on-the-board bets 22, as well as off-the-board bets 24 on a betting event having a set of event participants, such as a horse race, dog race, auto race, or golf tournament, for example. An on-the-board bet 22 is a bet that a particular participant, at least one of a subset of participants, or all of a subset of participants will finish in a predetermined subset of finishing positions of an event. For example, in a horse race, an on-the-board bet 22 may be a bet that Horse #3 will finish in first place, second place, or third place in the race. In another example, an on-the-board bet 22 may be a bet that either Horse #3 or Horse #4 will finish in first place, second place, or third place in the race. In yet another example, an on-the-board bet 22 may be a bet that both Horse #3 and Horse #4 will finish in first place, second place, or third place in the race. Although the predetermined subset of finishing positions is described in terms of first place, second place, or third place, it should be understood that the predetermined subset of finishing positions could be any number and combination of finishing positions for the event. Therefore, the predetermined subset of finishing positions could be, for example, first place; first place and last place; second place and third place; first place, second place, third place, and fourth place; etc.

An off-the-board bet 24, on the other hand, is a bet that the particular participant, all of the subset of participants, or at least one of a subset of participants will not finish in the predetermined subset of finishing positions of the event. For example, in a horse race, an off-the-board bet 24 may be a bet that Horse #3 will not finish in first place, second place, or third place in the race. In another example, an off-the-board bet 24 may be a bet that neither Horse #3 nor Horse #4 will finish in first place, second place, or third place in the race. In still another example, an off-the-board bet 24 may be a bet that at least one of Horse #3 or Horse #4 will not finish in first place, second place, or third place in the race.

The on-the-board bets 22 and off-the-board bets 24 described herein may appeal to bettors that do not like to bet on the participants who are favored in a particular event. Rather than not betting at all, bets 12 provide an alternative to these types of bettors. However, bets 12 could be used with any participants, not just the favorite. Bets 12 also appeal to bettors seeking an alternative to a traditional "across-the-board" wager (which is in reality a series of wagers to win, place, and show on one horse in one race), either because of the lower nominal cost of the wager (e.g., $2 for an "on or off" bet versus $6 for an "across-the-board" bet), or because of the possibility of a better return.

In some embodiments, more than one on-the-board bet 22 may be available to clients 20.

Similarly, more than one off-the-board bet 22 may be available to clients 20. However, particular on-the-board bets 22 are associated with particular off-the-board bets 24 for purposes of determining payouts. For example, an on-the-board bet 22 that Horse #3 will finish in first place, second place, or third place is associated with a corresponding off-the-board bet 24 that Horse #3 will not finish in first place, second place, or third place, for purposes of determining payouts. Therefore, the total amounts bet on the on-the-board bet 22 that Horse #3 will finish in first place, second place, or third place is pooled with the total amounts bet on the off-the-board bet 24 that Horse #3 will not finish in first place, second place, or third place. These pooled amounts form a betting pool 54. Multiple betting pools 54 are formed based on the placement of various on-the-board bets 22 and corresponding off-the-board bets 24. In this regard, system 10 is a pari-mutuel betting system in which particular bets 22 regarding a particular event are pooled with corresponding bets 24, a commission (or "take-out") is taken by the track or other wagering provider in one embodiment, and the remainder is distributed among the winning bettors for any given betting pool 54.

Betting system interfaces 14 may include any suitable interface between a client 20 and betting system platform 16. For example, as shown in FIG. 1, betting system interfaces 14 may include physical interfaces, such as track interfaces 26 and/or off-track interfaces 28. Track interfaces 26 are generally located at a track, while off-track interfaces 28 are generally located at an off-track-betting (OTB) establishment, such as an OTB parlor. Track interfaces 26 and off-track interfaces 28 may include tellers 30, which may receive bets 12 from and distribute payouts to clients 20, and/or monitors 32, which may be viewed by clients 20 to monitor betting information such as the event time, the current odds, and the projected or actual payouts for various bets 12, for example. In some situations, such information may be updated substantially in real time or at preset intervals (such as every 30 seconds, for example) as new bets 12 are placed and/or as information regarding the event changes, for example. Monitors 32 may include, for example, tote-boards or closed-circuit televisions located at a track or OTB establishment.

Track interfaces 26 and/or off-track interfaces 28 may also include one or more self-service betting machines 33. In some embodiment, self-service betting machines 33 allow clients 20 to insert payment into the machine (such as cash or by using a voucher or a credit or debit card), place one or more on-the-board bets 22 and/or off-the-board bets 24, and receive a printout (such as a ticket, for example) indicating the bet or bets placed. Printouts for winning bets may be inserted into the self-service betting machine, such as to receive a payment voucher (which may be used to receive a payout from a teller 30) or to place additional bets 12. In other embodiments, self-service betting machines 33 allow clients 20 to use a credit card, a debit card, or a smart card to place bets 12. The credit or debit card may have an associated account, which may be a betting account provided and/or managed by a betting account provider using, for example, a centralized computer system. The smart card may itself store information regarding a betting account and various bets, or may also be linked to a betting account using a centralized computer system. In some embodiments, after the betting event is completed, a client 20 may insert or swipe his or her credit, debit, or smart card in the self-service betting machines 33 in order to update the balance on the card. Self-service betting machines 33 may also allow the client 20 to print out payment vouchers which may be presented to a teller 30 in order to receive payments.

As shown in FIG. 1, betting system interfaces 14 may also include various non-physical interfaces, such as one or more telephone operators 34 and one or more websites 36. Clients 20 may access or communicate with such non-physical interfaces via one or more communication networks 44. Communication networks 44 may include one or more servers, routers, switches, repeaters, backbones, links and/or any other appropriate type of communication devices coupled by links such as wire line, optical, wireless, or other appropriate links. In general, communication network 44 may include any interconnection found on any communication network, such as a telephone network, a local area network (LAN), metropolitan area network (MAN), wide area network (WAN), the Internet, portions of the Internet, or any other data exchange system. To access betting system interface 14 using communication networks 44, clients 20 may use a computer, a personal digital assistant (pda), a cell-phone, a remote paging device, an electronic mail communication device, a handheld betting device, or any other suitable mobile device. In certain embodiments, clients 20 may receive any suitable information, such as betting information, from betting system platform 16 via mobile devices using, for example, communication networks 44 and betting system interfaces 14.

Telephone operators 34 may communicate betting information to, and take bets 12 from, clients 20. Similarly, websites 36 may communicate betting information to clients 20 and allow clients 20 to place bets 12. One or more of such websites 36 may be hosted by one or more servers associated with system 10, which server or servers may also host betting system platform 16 in some embodiments. In some embodiments, betting information available to clients 20 via websites 36 may be updated substantially in real time or at preset intervals (such as every 30 seconds, for example) as new bets 12 are placed and/or as information regarding the event changes, for example.

In some embodiments, one or more websites 36 may be provided by, or associated with, an Internet betting provider 46, for example. Internet betting provider 46 may provide Internet account wagering by providing online betting accounts to one or more clients 20. Using an online betting account, a client 20 may interface with one or more websites 36 associated with the Internet betting provider 46 in order to fund the account, view betting information regarding betting events, and place bets (such as on-the-board bets 22 and/or off-the-board bets 24). Such online betting accounts may include one or more various types of accounts, such as deposit accounts, credit accounts, stop-loss accounts, and hybrid accounts, for example.

As discussed above, betting system platform 16 is operable to receive bets 12 (including both on-the-board bets 22 and off-the-board bets 24) from betting system interfaces 14, store the received bets 12, determine appropriate odds and payouts, and communicate such odds and payouts to one or more of the betting system interfaces 14, which may then display such odds and/or payouts to clients 20. As shown in FIG. 1, betting system platform 16 includes a processor 38 coupled to a memory 40. Processor 38 is generally operable to execute various algorithms or calculations to determine current bet data 50, such as bet amounts 52, betting pools 54 and/or potential payout data 56.

As discussed above, betting system platform 16 comprises processor 38 and memory 40. Processor 38 may comprise any suitable processor that executes a betting system software application 42 or other computer instructions, such as a central processing unit (CPU) or other microprocessor, and may include any suitable number of processors working together. Memory 40 may comprise one or more memory devices suitable to facilitate execution of the computer instructions, such as one or more random access memories (RAMs), read-only memories (ROMs), dynamic random access memories (DRAMs), fast cycle RAMs (FCRAMs), static RAM (SRAMs), field-programmable gate arrays (FPGAs), erasable programmable read-only memories (EPROMs), electrically erasable programmable read-only memories (EEPROMs), microcontrollers, or microprocessors.

Memory 40 is generally operable to store various information that may be used by processor 38 in determining odds and/or payouts. For example, memory 40 may comprise any suitable number of databases, which may be co-located or physically and/or geographically distributed. In the example shown in FIG. 1, memory 40 may store any or all of the following: betting system software application 42, current bet data 50, one or more event parameters 58, one or more bet parameters 60, one or more calculation rules 62, one or more event results 64, and one or more bet results 66.

Event parameters 58 may comprise various parameters of one or more betting events, such as, for example, the type of event, the time, date and location of the event and/or the number (or in some cases, the name) of each of the participants in the event. Bet parameters 60 may comprise various parameters of one or more received bets 12, such as the identity of the client 20 who placed the bet 12, the manner in which the bet 12 was placed (such as via telephone, the Internet, or in person at a track or OTB establishment, for example), the type of bet 12 (such as whether the bet 12 is an on-the-board bet 22 or an off-the-board bet 24, for example), the commission rate on the bet 12, the participant or participants covered by the bet 12 and/or the amount of the bet 12, for example. Calculation rules 62 may comprise various equations or other algorithms to be used by processor 38 in determining various current bet data 50. Examples of such equations are illustrated and discussed below with reference to equations 100-110 of FIGS. 3A and 3B. Event results 64 may comprise various data regarding the results of one or more betting events, such as the final position of each participant in an event, whether there was a tie for any position and/or whether any participants did not finish the event, for example. Bet results 66 may comprise various data regarding the results of various bets 12, such as the identity of the client 20 who placed the bet 12, whether the bet 12 was a winning bet, the determined payout for the bet 12 and/or whether the payout was distributed to the client 20, for example.

As discussed above, one or more communication networks 18 couple and facilitate wireless or wireline communication between one or more betting system interfaces 14 and betting system platform 16. Each communication network 18 may include one or more servers, routers, switches, repeaters, backbones, links and/or any other appropriate type of communication devices coupled by links such as wire line, optical, wireless, or other appropriate links. In general, each communication network 18 may include any interconnection found on any communication network, such as a local area network (LAN), metropolitan area network (MAN), wide area network (WAN), the Internet, portions of the Internet, or any other data exchange system.

As discussed above, processor 38 is operable to execute betting system software application 42 to determine current bet data 50, such as bet amounts 52, betting pools 54 and/or potential payout data 56. Processor 38 may determine such current bet data 50 based at least on data received from memory 40 and/or one or more betting system interfaces 14. In addition, processor 38 may update such current bet data 50 based on new information being received by betting system platform 16. In some embodiments, processor 38 may update current bet data 50 in real time, substantially in real time, or at preset intervals (such as every 30 seconds, for example).

As shown in FIG. 1, current bet data 50 may be communicated to one or more betting system interfaces 14 via communication network 18, as indicated by arrow 70. Current bet data 50 may then be made available to clients 20, such as via tote boards or monitors 32 located at a track or OTB establishment, for example, or on an appropriate website 36 that may be accessed by clients 20, for example. In this manner, clients 20 may have access to real-time or substantially real-time current bet data 50 regarding various betting events.

As discussed above, processor 38 may calculate various current bet data 50 using various algorithms or equations. FIGS. 2A and 2B illustrate examples of such algorithms or equations in accordance with one embodiment of the present invention. In particular, FIGS. 2A and 2B illustrate various equations for calculating the current potential payout 56 for each bet 12, including both on-the-board bets 22 and off-the-board bets 24, associated with a particular betting event. The equations shown in FIG. 2A account for take-out, while the equations shown in FIG. 2B do not. In particular, FIG. 2A illustrates a Betting Pool equation 100, a Take-Out equation 102, an On-the-Board Payout Per Dollar (after Take-Out) equation 104, and an Off-the-Board Payout Per Dollar (after Take-Out) equation 106. FIG. 2B illustrates an On-the-Board Payout Per Dollar (without Take-Out) equation 108 and an Off-the-Board Payout Per Dollar (without Take-Out) equation 110. The equations shown in FIGS. 2A and 2B are best understood when viewed in conjunction with FIG. 3.

FIG. 3 illustrates a table 150 comprising example bet data 50 for various on-the-board bets 22 and corresponding off-the-board bets 24. In particular, each row 152 of table 150 identifies a particular on-the-board bet 22 and corresponding off-the-board bet 24. Moreover, each row 152 also includes bet amounts 52, such as Total On-the-Board Bet Amounts 154 and Total Off-the-Board Bet Amounts 156; Betting Pool 54; Take-Out 158; and payout data 56, such as On-the-Board Payout Per Dollar 160 and Off-the-Board Payout Per Dollar 162.

Referring to row 152*a* of table 150, the On-the-Board Bet 22 comprises a bet that Horse #3 will finish in first place, second place, or third place in the event. The corresponding Off-the-Board Bet 24 comprises a bet that Horse #3 will not finish in first place, second place, or third place in the event. Multiple clients 20 may make these bets 22 or 24 in various bet amounts 52. In the example depicted in row 152*a*, the Total On-the-Board Bet Amounts 154 made by clients 20 on bet 22 is $500. The Total Off-the-Board Bet Amounts 156 made by clients 20 on bet 24 is $1,000. Therefore, the Betting Pool 54 for this particular On-the-Board bet 22 and corresponding Off-the-Board bet 24 is determined to be $1,500 using equation 100. If the Take-Out 158 is figured at a commission rate of 15%, for example, then the Take-Out 158 for this set of bets 12 is determined to be $225 using equation 102. Based on the Bet Amounts 52, the Betting Pool 54 and the Take-Out 158, the payout data 56 may be determined. In particular, the On-the-Board Payout Per Dollar 160 may be determined to be $2.55 using equation 104. Although it is not depicted in table 150, the On-the-Board Payout Per Dollar 160 may also be determined using equation 108 if Take-Out 158 is not to be charged. The Off-the-Board Payout Per Dollar 162 may be determined to be $1.27 using equation 106. Although it is not depicted in table 150, the Off-the-Board Payout Per Dollar 162 may also be determined using equation 110 if Take-Out 158 is not to be charged.

Rows 152*b*-152*e* provide additional On-the-Board bets 22, Off-the-Board bets 24, and corresponding bet amounts 52, Betting Pool 54, Take-Out 158 and payout data 56. Therefore, it can be seen that each separate set of bets 22 and 24 depicted by rows 152 of table 150 can be structured into separate Betting Pools 54 for determining payouts 56. Referring in particular to row 152*c*, it can be seen that based on the allocation of bet amounts 52 weighted toward the Off-the-Board bet 24 (i.e., $2,000 on bet 24 as compared to $250 on bet 22), the Off-the-Board Payout Per Dollar 162 is determined to be $0.95 using equation 104. However, in such a situation, the track or wagering facility may theoretically cancel all bets 12 depicted in row 152*c* prior to the event and refund all bets 12 to clients 20. Alternatively, the bets 12 may be maintained and the track or wagering facility may pay a minimum Off-the-Board Payout Per Dollar 162 to clients 20, such as $1.05, if the Off-the-Board bets 24 win.

Figure 4:
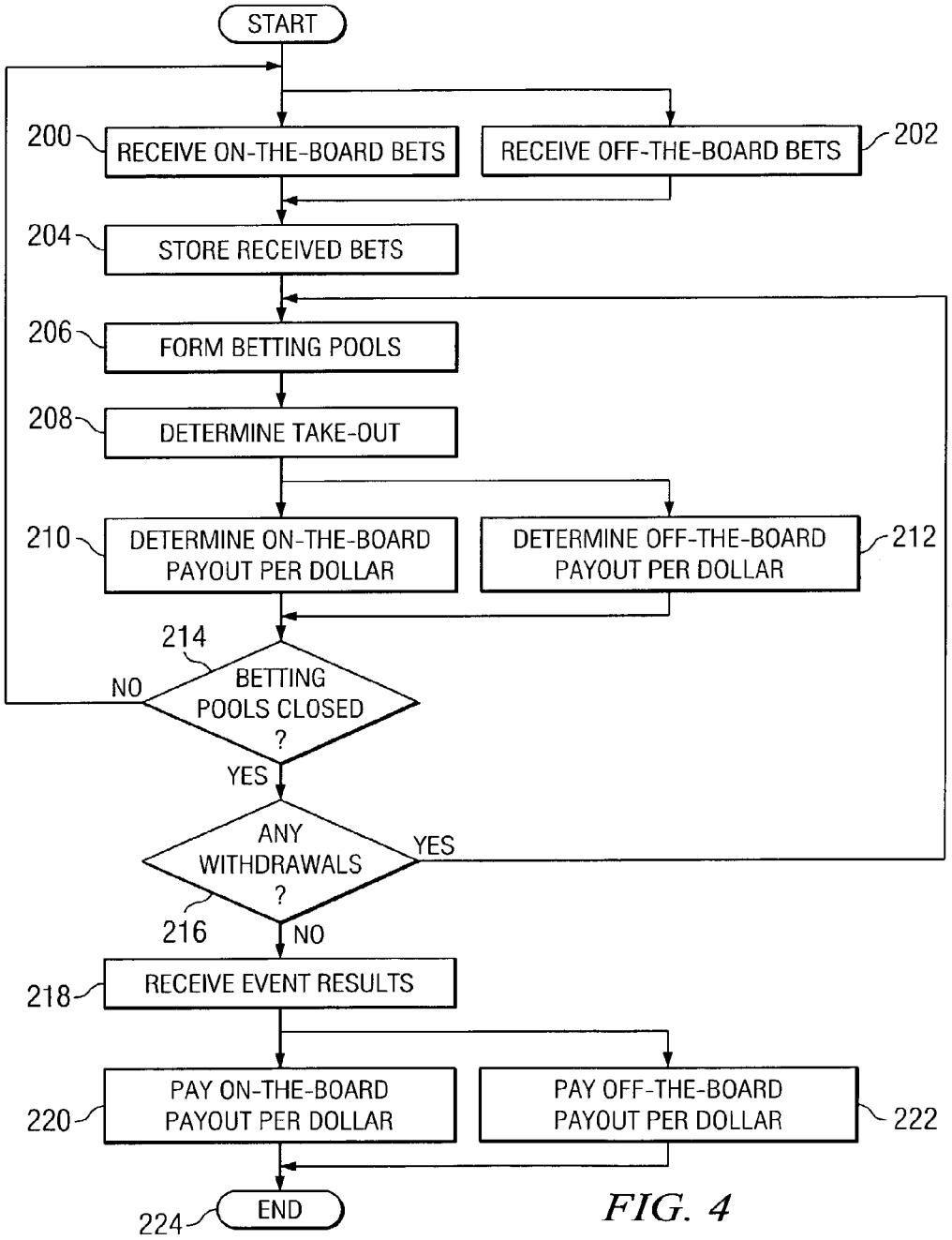
FIG. 4 is a flowchart illustrating an example method of receiving, managing, and paying on-the-board bets and off-the-board bets in accordance with an embodiment of the present invention.

FIG. 4 is a flowchart illustrating an example method of receiving, managing, and paying on-the-board bets 22 and off-the-board bets 24 in accordance with an embodiment of the present invention. At step 200, on-the-board bets 22 are received from one or more clients 20 via one or more betting system interfaces 14, such as described above with reference to FIG. 1. For example, in the example horse race discussed above with reference to FIG. 3, assume various on-the-board bets 22 are received which create the entries for rows 152 of table 150 depicted in FIG. 3. At step 202, off-the-board bets 24 corresponding to the on-the-board bets 22 received at step 200 are received from one or more clients 20 via one or more betting system interfaces 14, such as described above with reference to FIG. 1. In some situations, steps 200 and 202 may be occur simultaneously, or may at least partially overlap.

Each on-the-board bet 22 or off-the-board bet 24 received at steps 200 and/or 202 may be stored at step 204, such as within memory 40, for example. At step 206, the amounts bet on particular on-the-board bets 22 may be added to the amounts bet on corresponding off-the-board bets 24 to form betting pools 54. For example, as described above with regard to FIG. 3, amounts 154 may be added to amounts 156 for each set of bets 22 and 24 depicted in rows 152 of table 150 to determine separately structured betting pools 54. Therefore, a Betting Pool 54 of $1,500 may be determined for the bets 22 and 24 depicted in row 152*a* of table 150 while a separate Betting Pool 54 of $2,250 may be determined for the bets 22 and 24 depicted in row 152*c* of table 150. In some embodiments, a Take-Out 158 is determined at step 208. For example, a commission rate of 15% may be applied to the each Betting Pool 54 determined at step 206 to determine a Take-Out 158. Therefore, the Take-Out 158 determined for the Betting Pool 54 associated with row 152*a* is $225, while the Take-Out 158 determined for the Betting Pool 54 associated with row 152*c* is $337.50.

At step 210, the On-the-Board Payout Per Dollar 160 may be determined for each separate betting pool 54 using equations 104 or 108. Therefore, the On-the-Board Payout Per Dollar 160 for bets 22 depicted in row 152*a* of table 150 is determined to be $2.55, while the On-the-Board Payout Per Dollar 160 for bets 22 depicted in row 152*c* of table 150 is determined to be $7.65. At step 212, the Off-the-Board Payout Per Dollar 162 may be determined for each separate betting pool 54 using equations 106 or 110. Therefore, the Off-the-Board Payout Per Dollar 162 for bets 24 depicted in row 152*a* of table 150 is determined to be $1.27, while the Off-the-Board Payout Per Dollar 162 for bets 22 depicted in row 152*c* of table 150 is determined to be $0.95 (which may be adjusted to $1.05 as described above).

At least portions of steps 210 and 212 may be performed simultaneously. In addition, in some embodiments, steps 210 and 212 are performed in real time, substantially in real time, or at preset intervals (such as every 30 seconds, for example) as on-the-board bets 22 and/or off-the-board bets 24 are received by betting system platform 16.

At step 214, it is determined whether the Betting Pools 54 are closed. In some embodiments, the Betting Pools 54, which includes all bet amounts 52 to be considered in the final determination of payouts 56, may be closed substantially at the time of or after betting is closed on the event. For example, in some embodiments, bets which are made prior to the close of betting but are processed (at least partially) after the close of betting (such as due to processing and transmission delays, for example) may be included within the corresponding Betting Pool 54.

If the Betting Pools 54 are still open, the method may return to steps 200 through 212 to receive and store additional on-the-board bets 22 and/or off-the-board bets 24, and to recalculate the payouts 160 and 162. In this manner, betting system platform 16 may update the payouts 160 and 162 associated with the various bets 12 upon an event. In some embodiments, betting system platform 16 may perform such updates continuously and/or in real time, substantially in real time, or at preset intervals (such as every 30 seconds, for example).

If it is determined at step 214 that the Betting Pools 54 are closed, the method proceeds to step 216. At step 216, it is determined whether any of the participants in the event will not be competing in the event, such as if a participant is scratched, withdrawn, or becomes a non-runner, for example. For example, betting system platform 16 may receive a notification that one or more of the participants has been withdrawn from the event prior to the start of the event. If it is determined at step 216 that one or more participants will not be competing in the event, the method may return to step 206 to recalculate betting pools 54 based on the updated set of participants in the event. In certain circumstances, a particular Betting Pool 54 may be terminated and the bet amounts 52 associated with that Betting Pool 54 may be refunded to clients 20. Otherwise, the method may proceed to step 218 where the results of the event are received, such as the final position of each participant in the event and whether there was a tie for any position, for example.

At step 220, On-the-Board Payout Per Dollar 160 may be paid to clients 20 who made successful on-the-board bets 22. For example, assuming in the example discussed above that Horse #3 finished in first place in the race, On-the-Board Payout Per Dollar 160 may be paid to clients 20 who made the on-the-board bets 22 depicted in rows 152*a* and 152*b*. In some embodiments, On-the-Board Payout Per Dollar 160 may be paid according to the final determination made at step 210. In alternative embodiments, On-the-Board Payout Per Dollar 160 may be distributed according to a final determination made after the betting closed or even after the event was completed.

At step 222, Off-the-Board Payout Per Dollar 162 may be paid to clients 20 who made successful off-the-board bets 24. For example, assuming in the example discussed above that neither Horse #3 nor Horse #4 finished in first place, second place, or third place, Off-the-Board Payout Per Dollar 162 may be distributed to clients 20 who made the off-the-board bets 24 depicted in rows 152*a*, 152*b*, and 152*e*. In some embodiments, Off-the-Board Payout Per Dollar 162 may be paid according to the final determination made at step 212. In alternative embodiments, Off-the-Board Payout Per Dollar 162 may be paid according to a final determination made after the betting closed or even after the event was completed. In some situations, steps 220 and 222 may occur simultaneously, or may at least partially overlap. The method terminates at step 224.

Although embodiments of the invention and their advantages are described in detail, a person skilled in the art could make various alterations, additions, and omissions without departing from the spirit and scope of the present invention as defined by the appended claims.

What is claimed is:

1. A betting machine comprising:

a memory;

a display device;

a card swiping device;

at least one processor to:

render a betting interface on the display device;

generate a betting pool in an area of the memory;

detect entry of a first bet from the betting interface, the first bet being a wager that a participant will rank in a plurality of finishing positions upon completion of a race;

detect entry of a first bet amount via the card swiping device, the first bet amount being associated with the first bet;

detect entry of a second bet from the betting interface, the second bet being a wager that a participant will not rank in a plurality of finishing positions upon completion of the race;

detect entry of a second bet amount via the card swiping device, the second bet amount being associated with the second bet;

in response to determining that the first bet was entered before a certain period of time elapsed, add the first bet amount to the betting pool in the memory;

in response to determining that the second bet was entered before the certain period of time elapsed, add the second bet amount to the betting pool in the memory; and calculate a payout amount based at least partially on the betting pool stored in the memory.

2. The betting machine of claim 1, wherein the at least one processor is further configured to decline adding the first bet amount to the betting pool, in response to determining that the first bet was entered after the certain time period elapsed.

3. The betting machine of claim 1, wherein the at least one processor is further configured to decline adding the second bet amount into the betting pool, in response to determining that the second bet was entered after the certain time period elapsed.

4. The betting machine of claim 1, wherein the at least one processor is further configured to add the first bet amount to the betting pool despite receiving the first bet after the certain period of time has elapsed.

5. The betting machine of claim 1, wherein the at least one processor is configured to add the second bet amount to the betting pool despite receiving the second bet after the certain period of time has elapsed.

6. The betting machine of claim 1, wherein the at least one processor is further configured to add at least one other bet amount of at least one other bet received from a given client device to the betting pool, in response to determining that the at least one other bet was entered before the certain period of time elapsed.

7. The betting machine of claim 1, wherein the at least one processor is further configured to receive a request via the betting interface to withdraw a previously submitted bet amount from the betting pool.

8. The betting machine of claim 7, wherein the at least one processor is further configured to calculate a new payout amount, in response to receiving the request to withdraw the previously submitted bet amount from the betting pool.

9. A method comprising:

rendering, by at least one processor, a betting interface on a display device;

generating, by the at least one processor, a betting pool in an area of a memory;

detecting, by the at least one processor, a first bet, via the display device, the first bet being a wager that a participant will rank in a plurality of finishing positions upon completion of a race, detecting, by the at least one processor, a first bet amount via a card swiping device, the first bet amount being associated with the first bet;

detecting, by the at least one processor, a second bet, via the betting interface, the second bet being a wager that a participant will not rank in a plurality of finishing positions upon completion of the race, the second bet being associated with a second bet amount;

detecting, by the at least one processor, a second bet amount via the card swiping device, the second bet amount being associated with the second bet;

in response to determining that the first bet was entered before a certain period of time elapsed, adding, by the at least one processor, the first bet amount to the betting pool in the memory;

in response to determining that the second bet was entered before the certain period of time elapsed, adding, by the at least one processor, the second bet amount to the betting pool in the memory; and calculating, by the at least one processor, a payout amount based at least partially on the betting pool stored in the memory.

10. The method of claim 9, further comprising declining, by the at least one processor, to add the first bet amount to the betting pool, in response to determining that the first bet was entered after the certain time period elapsed.

11. The method of claim 9, further comprising declining, by the at least one processor, to add the second bet amount into the betting pool, in response to determining that the second bet was entered after the certain time period elapsed.

12. The method of claim 9, wherein adding the first bet amount to the betting pool further comprises adding, by the at least one processor, the first bet amount to the betting pool despite receiving the first bet after the certain period of time has elapsed.

13. The method of claim 9, wherein adding the second bet amount to the betting pool further comprises adding, by the at least one processor, the second bet amount to the betting pool despite receiving the second bet after the certain period of time has elapsed.

14. The method of claim 9, further comprising adding, by the at least one processor, at least one other bet amount of at least one other bet received from a given client device to the betting pool, in response to determining that the at least one other bet was entered before the certain period of time elapsed.

15. The method of claim 9, further comprising receiving, by the at least one processor, a request via the betting interface to withdraw a previously submitted bet amount from the betting pool.

16. The method of claim 15, further comprising calculating, by the at least one processor, a new payout amount, in response to receiving the request to withdraw the previously submitted bet amount from the betting pool.

17. A non-transitory computer-readable medium with instructions stored therein which upon execution cause at least one processor to render a betting interface on a display device;

generate a betting pool in an area of a memory;

detect entry of a first bet from the betting interface, the first bet being a wager that a participant will rank in a plurality of finishing positions upon completion of a race;

detect entry of a first bet amount via the card swiping device, the first bet amount being associated with the first bet;

detect entry of a second bet from the betting interface, the second bet being a wager that a participant will not rank in a plurality of finishing positions upon completion of the race;

detect entry of a second bet amount via the card swiping device, the second bet amount being associated with the second bet;

in response to determining that the first bet was entered before a certain period of time elapsed, add the first bet amount to the betting pool in the memory;

in response to determining that the second bet was entered before the certain period of time elapsed, add the second bet amount to the betting pool in the memory; and calculate a payout amount based at least partially on the betting pool stored in the memory.

18. The non-transitory computer-readable medium of claim 17, wherein the instructions stored therein, when executed, further cause the at least one processor to decline adding the first bet amount to the betting pool, in response to determining that the first bet was entered after the certain time period elapsed.

19. The non-transitory computer-readable medium of claim 17, wherein the instructions stored therein, when executed, further cause the at least one processor to decline adding the second bet amount into the betting pool, in response to determining that the second bet was entered after the certain time period elapsed.

20. The non-transitory computer-readable medium of claim 17, wherein the instructions stored therein, when executed, further cause the at least one processor to add the first bet amount to the betting pool despite receiving the first bet after the certain period of time has elapsed.

* * * * *